US005088533A

United States Patent [19]

Binder

[11] Patent Number: 5,088,533

[45] Date of Patent: Feb. 18, 1992

[54] METHOD AND DEVICE FOR THE PRODUCTION OF WOOD SHEETS FROM CUT WOOD

[76] Inventor: Hans Binder, Haus Nr 396, A-6263 Fugen, Austria

[21] Appl. No.: 627,463

[22] Filed: Dec. 14, 1990

Related U.S. Application Data

[63] Continuation-in-part of Ser. No. 454,583, Dec. 12, 1989, Pat. No. 5,002,106.

[30] Foreign Application Priority Data

Dec. 30, 1988 [EP] European Pat. Off. ..... 88121905.9
Jan. 2, 1990 [EP] European Pat. Off. ..... 90100005.9

[51] Int. Cl.[5] ..... B27M 1/00

[52] U.S. Cl. ..... 144/364; 34/9.5; 34/26; 34/28; 144/3 N; 144/39; 144/120; 144/369; 144/380

[58] Field of Search ..... 34/9.5, 26, 48, 201, 34/28; 118/697; 144/1 R, 3 R, 39, 120, 184, 190, 356, 364, 369, 380

[56] References Cited

U.S. PATENT DOCUMENTS

| | | | |
|---|---|---|---|
| 2,763,069 | 7/1952 | Vaughan . | |
| 3,750,303 | 8/1973 | Gates et al. . | |
| 4,185,672 | 1/1980 | Vit et al. . | |
| 4,362,197 | 12/1982 | Wick et al. . | |
| 4,516,526 | 5/1985 | Drockila . | |
| 4,934,228 | 6/1990 | Bolton | 144/3 R |
| 5,002,106 | 3/1991 | Binder | 144/3 R |

FOREIGN PATENT DOCUMENTS

| | | |
|---|---|---|
| 1097193 | 11/1976 | Canada . |
| 2124086 | 5/1971 | Fed. Rep. of Germany . |
| WO 88/00517 | 7/1987 | PCT Int'l Appl. . |

*Primary Examiner*—W. Donald Bray
*Attorney, Agent, or Firm*—Lowe, Price, LeBlanc & Becker

[57] ABSTRACT

A method for the production of finished wood sheets from rough cut wood includes the steps of conditioning the rough cut wood, as necessary, to obtain a predetermined mositure content equivalent to a humidity of at least 50%. The conditioned rough cut wood is cut into predetermined dimensions using a sawdust-free process and then immediately dried to obtain a low moisture content. The dried wood is further machined to eliminate rough edges of the finished sheet.

19 Claims, 3 Drawing Sheets

METHOD AND DEVICE FOR THE PRODUCTION OF WOOD SHEETS FROM CUT WOOD

This is a continuation-in-part of Ser. No. 07/454,583 filed Dec. 12, 1989 now U.S. Pat. No. 5,002,106.

TECHNICAL FIELD

The invention relates to wood processing and particularly to a method and device for the production of wood sheets from cut wood.

DESCRIPTION

Wood sheets are to be understood as relatively thin wood panels which are thicker than 2 to 3 mm and which are processed into high-grade products made up of one or more layers, such as, for example, natural wood panels made up of several layers, glue binders, glued laminated wood, window ledges, solid wood panels and the like.

According to the prior art, such wood sheets are generally produced in that the cut wood is firstly dried to a relatively low degree of humidity and that the cut wood planks are then sawn by means of bandsaws and the like into the individual wood sheets. Such a method has several disadvantages. On the one hand, the quality of the wood sheets produced in this way leaves something to be desired, since the wood sheets in the sawing process easily fray or become ragged, particularly if the region of knots and edges, with this occurring all the more, the drier the cut wood is which is to be cut. This results in a relatively high proportion of damaged goods.

A further disadvantage of the known method is to be seen in the relatively poor yield, i.e. the proportion of waste is relatively high. This lies in the fact that waste occurs on each cut by the saw, corresponding to the thickness of the saw cut. If, for example, wood sheets are produced with a thickness of 4 mm and if the saw cut width is 2.5 mm, then a wastage of approximately 40% of the cut wood material already results from this.

A further disadvantage in the method according to the prior art is to be seen in that in the production of the wood sheets, a relatively large amount of energy is consumed. The reason for this is that owing to the relatively wide cutting slit of the saw cut, a large amount of material has to be machined off.

On the other hand, it is known to produce wood sheets in a cutting device by means of sawdust-free cutting. The results which have been able to be achieved hereby to date are, however, likewise not very satisfactory. On the one hand, the yield here is increased by avoiding the saw cut, but on the other hand in this method a so-called residual sheet occurs, i.e., after cutting off the maximum number of wood sheets which can be cut from the cut wood plank with the required nominal thickness, a remainder is left behind, which has a smaller thickness than the nominal thickness of the wood sheets which are to be produced, and is therefore unable to be used further, in any case not in the respective continuation of production.

Furthermore, the quality of the wood sheets thus produced leaves much to be desired, especially since the individual wood sheets leave the cutting device in a greatly warped state, which derives from the fact that the wood sheets cut off from the cut wood plank are carried away obliquely to their original direction of transportation. In the known cutting device, consequently, the problem is posed, which has not been solved to date, of restoring such warped wood sheets into their non-warped, level or flat state at a justifiable expense.

The invention is therefore based on the problem of indicating a method which provides high-grade wood sheets at a justifiable expense, in which at the same time a maximum yield is to be achieved and, moreover, the necessary expenditure of energy is to be kept as low as possible. Furthermore, a device is to be created, which satisfies the above-mentioned conditions.

DISCLOSURE OF THE INVENTION

According to the invention wood planks are cut into individual wood sheets in a sawdust-free manner. The wood sheets are then dried and, according to requirements, one or more sides of the dried wood sheets are then subsequently machined, e.g., by grinding. The method steps are preferably carried out continuously, so that the individual wood sheets run through the entire installation automatically and continuously.

In a preferred further development of the invention, a further method step can be added before the method step of sawdust-free cutting, which further method step makes possible an optimization of the cut, such that no residual sheets arise. This method step, which is added in front, may consist of the fact that the cut wood is preconditioned as regards humidity, to achieve a uniform initial humidity before the method step of cutting; in particular it is pre-dried, whereby a humidity of the cut wood of at least 50% by weight, adapted to the respective type of wood.

Alternatively, or in addition, this method step which is added in front, may consist of the fact that the humidity of the cut wood which is fed to the cutting station is measured and the cutting parameters, such as in particular the contact pressure in the region of the cutting blade and or the cutting thickness are controlled according to the measured humidity. Tolerances which would otherwise lead to the occurrence of residual sheets, can be balanced out in this way.

The combination, according to the invention, of steaming, sawdust-free cutting, drying and subsequent working by machining leads to the following advantages:

Wood sheets of the highest quality are produced. The visible surfaces of the panel sheets treated by grinding have a high surface quality, since fraying in the region of knots as in the case of the prior art do not even occur at all here in this extent and, in addition, are largely eliminated during the grinding process. Since the cut wood is not, as in the known prior art, dried to a low degree of humidity before processing, the wood remains intact in the knot regions during cutting.

The energy required for the production of the wood sheets is less than in the prior art. Whereas in the prior art with every cut, wood is machined in the width of the saw cut, in the case of the method according to the invention, owing to the grinding process, material is merely removed in the width of a fraction of a millimeter; in the cutting device itself, no material is machined away. The total of the expenditure of energy necessary for cutting and for subsequent later treatment (grinding) is less than the expenditure of energy required during sawing.

Owing to the sawdust-free cutting of the wood sheets, practically no waste occurs in the cutting device. Since in the subsequent processing of the cut wood sheets likewise only a comparatively small amount of waste occurs, the method according to the invention produces an excellent yield. This is further improved in that an optimization of the cut is possible, such that even the so-called residual sheets, which have the same tolerances as the other wood sheets and .are therefore able to be used further just as the latter, can remain in the production cycle. Therefore, residual sheets can be completely avoided in the method according to the invention.

In the case of the method according to the invention, the material used is consequently decisively reduced compared with conventional methods. Thus, approximately 50% to 80% less waste occurs, so that a correspondingly higher yield of the starting material results.

The method according to the invention permits a production of sheets which is substantially more protective to the wood than conventional methods. For example, the drying and processing tears which otherwise occur in particular in the knot regions are largely eliminated or respectively are not present.

By the method according to the invention, in which the wood sheets are dried following cutting, particularly uniform drying results are achieved to down to approximately 6% wood humidity and even less. In the conventional technology, in which the wood is dried before cutting or prior to sawing, a further processing of the material with such a low wood humidity is no longer possible in practice or is only possible under certain conditions, i.e. with corresponding losses of quality. The drying of the wood sheets after the cutting of the cut wood planks additionally has the advantage that less energy is consumed in the drying process. This is because on the one hand the waste occurring in the case of the prior art during sawing, such as sawdust and residual sheets, are not also dried in the process and, moreover, the thinner material, which is already cut, is easier to dry than the substantially thicker starting material.

A further crucial advantage of the drying process added after the cutting process lies in that in the temperature-controlled drying process, in which drying is carried out at a temperature in the order of approximately 160°, the warping of the wood sheets which occurred in the cutting process, can be reversed again, so that completely flat, non-warped panel sheets leave the drier. Only under this condition are economically suitable uses produced for the method, known per se, of producing the wood sheets by means of cutting with a blade.

A further feature of the invention is based on the knowledge that in the sawdust-free cutting of the cut wood by means of cutting blades, one of the two side faces of the wood sheets, namely that on the cutting side, has a lower surface quality than the other, since on this side fibres are obviously destroyed on the surface in the cutting station, which causes these sides, hereinafter named "open" sheet sides, to have small tears and the like, which reduce the surface quality of this open sheet side. According to a further method step according to the invention, the wood sheets are therefore marked following the cutting process as regards their underside facing the cutting blade and/or their upper side facing away from the cutting blade, for example by a visual marking, so that up to the final processing of the wood sheets to the end product it can be established which side of the wood sheet is the open sheet side and which is the closed sheet side. Since this marking can disappear in the subsequent working process, the marking can be repeated if necessary following the subsequent working process. The marking which is applied to the wood sheets makes it possible to ensure that in the end product the visible surface or respectively surfaces are always formed by the closed sheet sides. Through this, a uniform quality of the end products can be ensured.

The subsequent machining device, which is arranged after the drying device, preferably comprises components which may be connected in individually for the selective subsequent working of the side faces of the wood sheets, running at a maximum of four parallel to the direction of advance. Such components are preferably formed from high speed grinding machines, in which, however, in particular the narrow sides of the wood sheets are alternatively also equalized and may be processed by high speed milling units. If required, also, several components may be connected in series. The components may serve for grinding, planing, milling and, if applicable, also for profiling the wood sheets, for example to remove the edges. The individual connectability of the individual components ensures that only those sides of the wood sheets are subsequently treated in which this is necessary from a technical point of view. For example, in a multi-layered board, the surfaces of the wood sheets lying on the inside of course do not have to be ground, or only under particular conditions. The entire processing in the region of the subsequent working is adapted to the later use of the wood sheets, i.e., the processing machines are designed such that different faces or respectively edges may not be processed, or else may be processed several times within one passage, depending on the setting.

Further advantageous features of the invention will emerge from the remaining sub-claims in connection with the following description, in which several example embodiments of the invention are illustrated in further detail with the aid of the drawing. In the drawing, in diagrammatic representation,

BEST MODE FOR CARRYING OUT THE INVENTION

Figure 1:
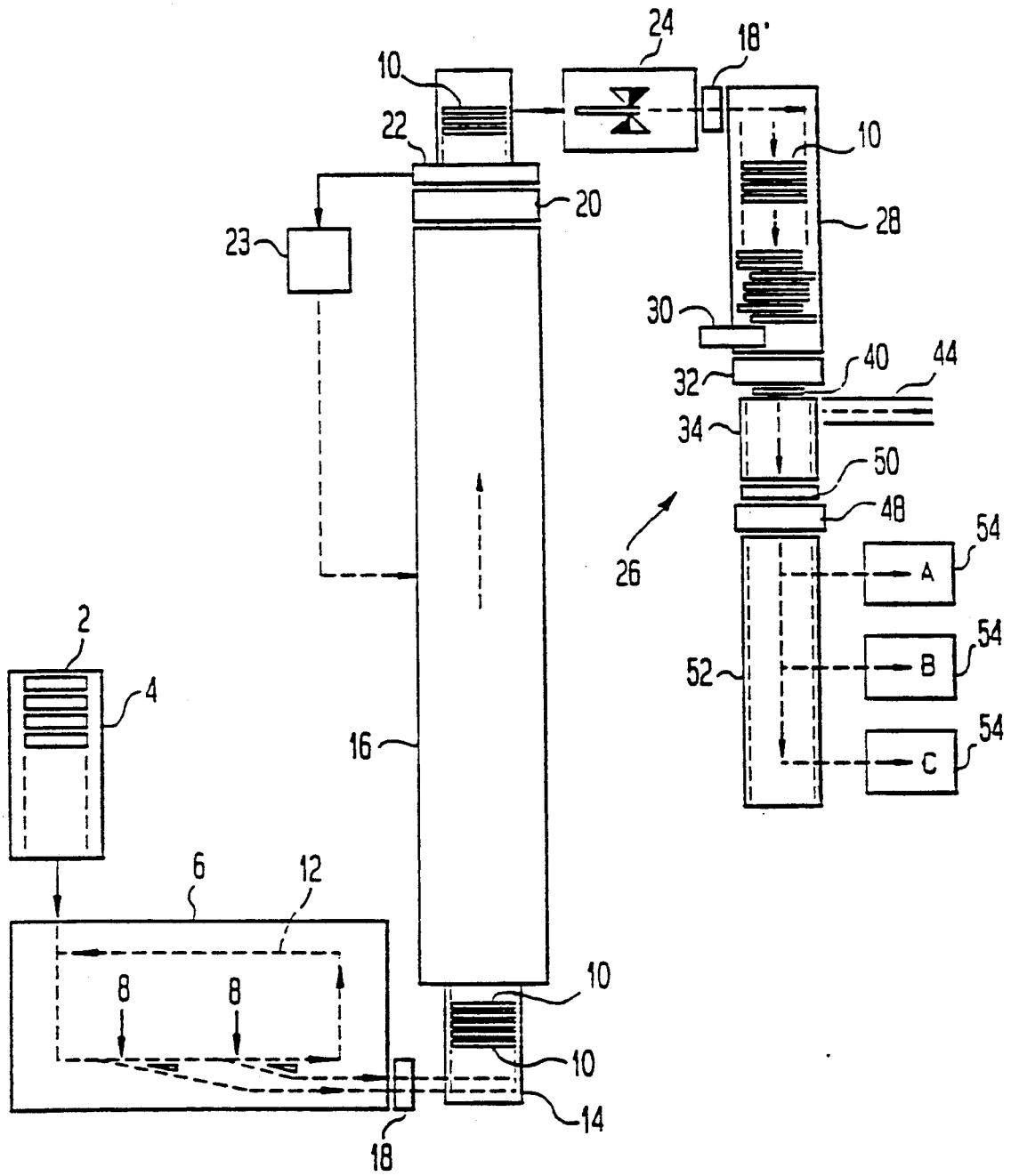
FIG. 1 shows a plan view of a device operating by a method according to the invention, for the production of wood sheets from cut wood.

As illustrated in FIG. 1, in the case of the example embodiment described here, the cut goods, in the form of cut wood, e.g. square timbers, boards, planks 2 etc. is firstly pre-dried or respectively preconditioned in a conditioning apparatus 4, in which the planks 2 are arranged so as to be stationary. The conditioning apparatus 4 may be a cut wood drier, which has the possibility that in certain areas within the cut wood drier, the wood humidity can be raised somewhat, according to requirements, for example by spraying or introducing vapor. The conditioning apparatus 4 sees to it that the planks leaving the conditioning apparatus have a very uniform initial humidity, whereby particularly good and accurate cutting results are achieved. The wood humidity of the planks 2 leaving the conditioning apparatus is approximately 50% or greater, depending on the variety of wood being processed.

After the wood planks are conditioned, they are separated and passed to the cutting apparatus, which is designated as a whole by the reference number 6, in which the aligned wood planks are carried past one or more cutting stations 8, arranged in series. Each time the plank is carried past a cutting station, in each case one wood sheet 10 is cut off, whereby the planks 2 are carried in a circuit (indicated by the dotted line 12) within the cutting apparatus 6 until the plank has been completely cut up into the individual wood sheets. The cutting apparatus 6 as such is substantially prior art and therefore requires no further explanation.

From the cutting apparatus 6, the wood sheets 10, which have been cut off from the planks 2, are automatically transported onto a conveyor 14, on which they are conveyed, arranged parallel adjacent to each other, to a drying apparatus 16 and through the latter. At the outlet of the cutting apparatus 6, a marking apparatus 18 is arranged, which marks the upwardly-pointing side of the wood sheets 10 leaving the cutting apparatus 6. This upwardly-pointing side is the closed side of the board sheet, which is suitable for later use as the visible face.

The uniformly dimensioned, marked wood sheets 10, arranged lying adjacent to each other, then run continuously through the drying apparatus 16, which is constructed as a tunnel drier. This tunnel drier is equipped with a temperature control, which makes possible an exact temperature setting in the drier. The wood sheets 10 leaving the drying apparatus are dried very uniformly to wood humidities up to approximately 6%.

In the case of the example embodiment according to FIG. 1, the speed at which the wood sheets 10 run through the tunnel drier is 2.5 m per minute, in which, for example in the case of sheets of pine with a thickness of 8 mm, the drying temperature is approximately 160° C. The volume of the drier is approximately 1000 $m^3$ and the amount of exhaust air here is approximately 15000 $m^3$ per hour. The tunnel drier, viewed in the conveying direction of the wood sheets, is divided into several, for example three, temperature zones. The wood sheets which are to be dried may be arranged inside the tunnel drier 16 lying one above the other in one or several levels.

The wood sheets 10 leaving the drying apparatus 16 then run through a cooling- or respectively air-conditioning apparatus 20, in which cooling of the wood sheets is accelerated, in order to have available for further processing in the subsequent working apparatus 24 the optimum material temperature for this.

Furthermore, after the cooling apparatus 20, a humidity-measuring station 22 is provided, in which the drying data of the wood sheets 10 are measured, to monitor and control the operation of the drying apparatus 16. For this purpose, the data measured in the humidity-measuring station 22 are fed to a data pick-up and memory apparatus 23, from which the data can be printed out on request, or can be further used for temperature control of the drying apparatus 16. From the drying apparatus 16 or respectively the humidity-measuring station 22, the dried wood sheets 10, the warping of which was reversed through the heat treatment in the drying apparatus 16 and which are therefore completely flat, are passed via suitable conveying means to the subsequent working apparatus 24. In the case of the example embodiment described, this subsequent working apparatus 24 comprises high speed grinding machines, working a maximum of four sides, which make possible a continuous further working of the dried sheets with speeds of advance of up to 150 m per minute. The individual units of the high speed grinding machines, known per se, are able to be connected in individually, so that always only those sides of the wood sheets are worked, for which such a subsequent working is necessary, taking into account the intended purpose of the sheets. In the subsequent working apparatus 24, the wood sheets are processed to of tolerances in the order of a total 1/10 mm. As already mentioned above, for example for working the edges of the wood sheets, high speed milling units may be used, which operate in combination with high speed grinding machines for the working of the upper and lower faces of the wood sheets.

Figure 2:
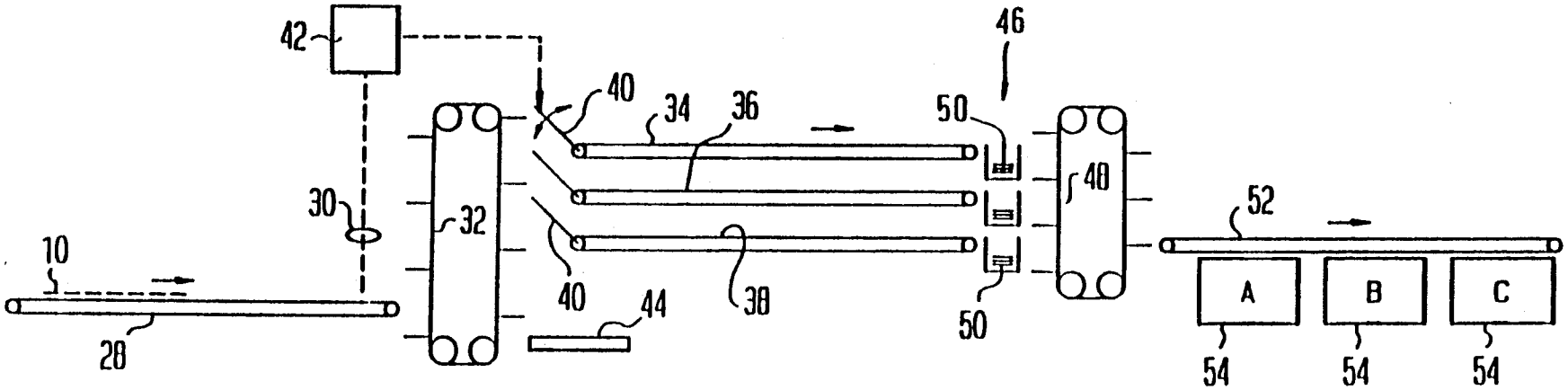
FIG. 2 shows a diagrammatic side view of the sorting apparatus of the device according to FIG. 1.

After the wood sheets are processed in the subsequent working apparatus 24, the wood sheets, which are marked if necessary once again in the further marking station 18' arranged after the subsequent working apparatus 24. The sheets are then passed to a sorting apparatus 26, in which the wood sheets are classified according to their quality and are passed to corresponding different transport paths. The structure of the sorting apparatus 26 can be seen from FIG. 2.

The wood sheets 10 coming from the subsequent working apparatus 24 are first continuously fed to a sorting line 28, in which the sheets are classified for quality, for example according to three classes of quality A, B and C. This classification may take place automatically or manually by properly trained personnel. The individual wood sheets 10 are displaced in depth according to the quality class allocated to them, whereby for example, one may proceed such that the wood sheets of quality class A, i.e., the highest quality class, are not displaced, the wood sheets of quality class B and C are displaced to the rear, whereby the wood sheets of quality class C are displaced deeper than those of quality class B. At the end of the sorting line 28, light barrier apparatus 30 are provided, which scan the respective positions of the wood sheets 10 running through beneath them, and hereby pick up and if required record the classification of the respective wood sheets 10.

Following the sorting line 28, the wood sheets 10 are transferred to a revolving elevator 32 which feeds the individual wood sheets 10 according to their respective quality class to different sorting sections 34, 36, 38. Associated with the sorting sections 34, 36, 38 in each case are corresponding flaps 40, which are controlled via a control apparatus 42 connected with the light barrier apparatus 30. The contrôl apparatus 42 causes the flaps 40 of the respective sorting section, associated with the respective quality class, to be actuated with a corresponding delay, depending upon the quality classification of the individual wood sheets 10.

Beneath processing sections 34 to 38, an additional further processing section 44 is provided, which is controlled, whereby the wood sheets deposited hereon can be fed directly to a further processing machine, for example a continuously operating side gluing press or the like. On the other hand, the wood sheets fed to the further processing sections 34 to 38 are stacked in the stacking stations 36, in which a counting apparatus, not shown in detail, is present, which counts the wood sheets deposited on the stack and initiates transport of a complete stack to a further elevator 38. Elevator 38 feeds the stack 50 of wood sheets to a conveying apparatus 52, which transports the individual stacks to final stack sites 54, where the wood sheets are stacked up, sorted according to their quality class. The previously sorted and stacked wooden sheets are then passed on with the aid of suitable transport apparatus to further processing lines, such as, for example, a fully automatic press line.

Figure 3:
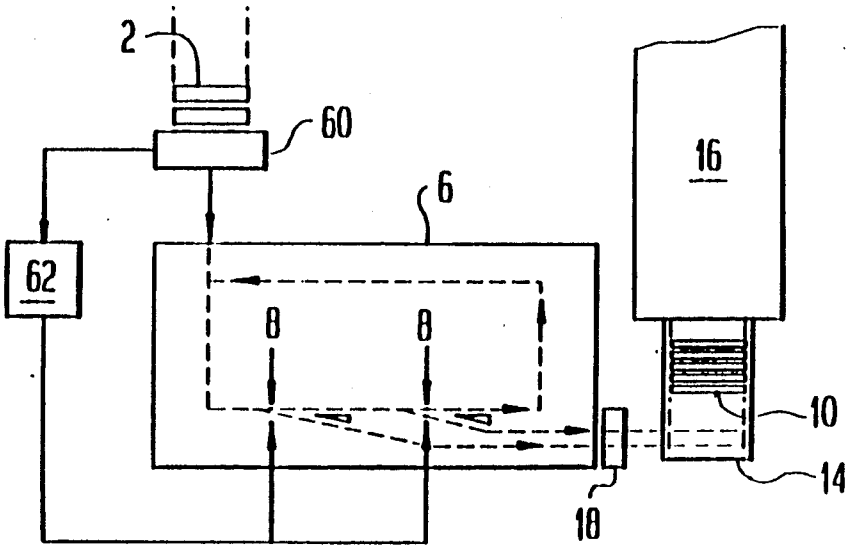
FIG. 3 shows a plan view onto a portion of a further form of embodiment of a device according to the invention.

FIG. 3 shows an alternative form of embodiment of a device according to the invention, in the region of the cutting apparatus and also the unit arranged before the latter. In the case of this example embodiment, a measuring station 60 is before the cutting apparatus 6 in the conveying path of the planks which are to be fed to this cutting apparatus. Measuring station 60 measures the humidity of the cut wood planks and generates a corresponding electrical output signal. This electrical output signal is fed to a control apparatus 62, which as a function of the measured humidity controls one or more cutting parameters of the cutting apparatus 6; the contact pressure of the planks which are to be cut against the cutting blades, or the cutting thickness, particularly come into consideration as suitable cutting parameters. In this way, the tolerances which result from differing wood humidities, can be eliminated, whereby the desired optimization of the cut can be achieved without the production of residual sheets.

In the example embodiment described above, the method steps will run continuously. Alternatively, however, they could also be carried out with a suitable intermediate storage between particular method steps, with subsequent loading.

The conditioning apparatus described above, which is added in front of the cutting apparatus 6, can be designed such that the cut wood is first predried to a predetermined wood humidity in a drying chamber for approximately one to two days depending on the thickness of the wood. Alternatively, according to a preferred embodiment of the invention, the predrying step is eliminated and the rough cut wood planks are brought directly into a steaming chamber by means of a stacker, where the surface of the wood is steamed. Afterwards the stacks of cut wood are conveyed to a tilting table one by one, where the cut wood is unstacked in layers. The tilting table is situated in an air-conditioning chamber, in which the temperature of the wood is maintained at approximately 70° to 80° C. From there the cut wood, which has been separated, is conveyed through a hot-water bath and subsequently fed to cutting station 8.

Figure 4:
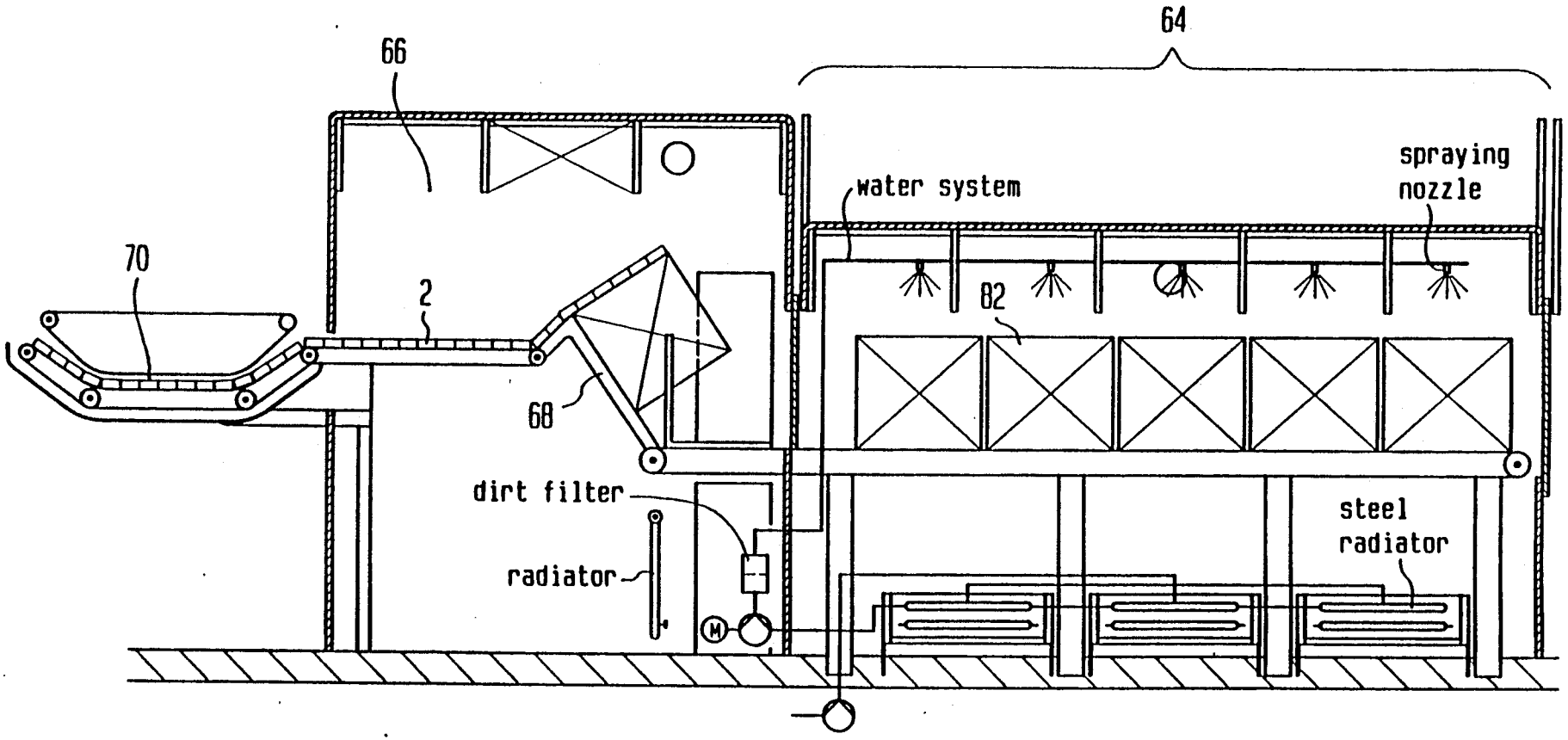
FIG. 4 shows a partially diagrammatic side view of the conditioning apparatus of the device according to the invention.

In FIG. 4 an embodiment of an installation for carrying out the above-mentioned method steps (steaming, separation in the air-conditioning chamber, and immersion in a water bath) is presented. The apparatus includes a steaming chamber 64, air-conditioning chamber 66, tilting table 68 and water bath 70.

Unhewn wood panels are heated in steaming chamber 64 using water vapor having a controlled temperature in the range of 80° to 150° C., optimally having a temperature of 110° C. The water vapor increases the average humidity of all of the unhewn wood panels, particularly along the exposed sides of the panels. Steaming also uniformly warms the unhewn wood panels and results in a uniform temperature throughout the stack of unhewn wood. The wood stays in the steaming chamber approximately 30 to 200 minutes as required to achieve a wood humidity of at least 50% by weight compared with dry wood. The wood humidity achieved in the steaming chamber may exceed 100% depending on the variety of wood being processed so that over one-half of the weight of the steamed wood panels comprise water.

In the air-conditioning chamber 66, which follows steaming chamber 64, the uniform humidity distribution achieved in the steaming chamber and the temperature of the individual panels are maintained. Air-conditioning chamber 66 also forms a buffer zone, in which the planks of plank stacks 82 are separated and fed to the water bath 70.

The separated wood panels lie adjacent to each other and are conveyed through a heated water bath 70 by means of suitable conveying means. The water bath softens the structure of individual panels immediately prior to cutting in cutting station 8 to reduce tearing or other damage to the wood sheets 10. Panels pretreated in this manner result in wood sheets which are distinctly less warped after leaving the cutting station 8.

The separated wood panels stay in the water bath 70 for approximately 2 to 5 minutes. The water bath has a temperature of up to 95° C., whereby at the cutting devices of the cutting station 8 arranged after the bath, a temperature of up to 70° C. can be achieved at the cutting slit.

The preparatory treatment of the planks described in connection with FIG. 4 has several advantages. First of all it results in a substantially improved cutting quality, especially in the region of knots. Further to this, it results in much gentler treatment of the wood during cutting in the cutting apparatus. Finally, optimal cutting results and a very good sheet parallelism can be achieved even in the case of excessively dry and otherwise non-optimal starting material.

Using the preparatory treatment described, the unevenness of cuts at the sheet surfaces are substantially reduced. The resultant sheets that have been cut and then dried are substantially planar and require minimal or no additional surface processing.

In the case of a further embodiment of the invention, the preconditioning of the cut wood can be carried out completely or also partially by means of microwave radiation. In doing so, an even distribution of humidity and temperature in the cut wood to be cut can be achieved in a comparatively simple and effective fashion.

I claim:

1. A method for the production of finished wood sheets from wood planks, comprising the steps of:

A) steaming said wood planks;

B) sawdust-free cutting of steamed wood planks into individual wood sheets having predetermined dimensions;

C) drying the individual wood sheets to have a predetermined moisture content; and then D) machining one or more sides of the dried wood sheets to form finished wood sheets.

2. The method according to claim 1, further comprising the step of preconditioning the wood planks by drying to have a predetermined humidity to achieve uniform initial humidity prior to said steaming step.

3. The method according to claim 1, further comprising the step of immersing said wood planks in a heated water bath after said steaming step.

4. The method according to claim 3, further comprising the step of conveying said wood planks for cutting immediately after said step of immersing said wood planks in a heated water bath.

5. The method according to claim 3, wherein the wood planks are conveyed through an air-conditioning zone between said steps of steaming and immersing said wood planks in a heated water bath.

6. A method for the production of finished wood sheets from wood planks, comprising the steps of:

A) sawdust-free cutting the wood planks into individual wood sheets having predetermined dimensions;

B) drying the individual wood sheets to have a predetermined moisture content; and then C) machining one or more sides of the dried wood sheets to form finished wood sheets.

7. The method according to claim 6, further comprising the step of preconditioning the wood planks using microwave radiation to have a predetermined uniform humidity and temperature prior to said sawdust free cutting step.

8. A device for use with a sawdust-free wood cutting apparatus for the production of finished wood sheets from wood planks, comprising:

a steaming chamber for heating and increasing the humidity of said wood planks prior to supplying said wood planks to said sawdust-free cutting apparatus;

a drying apparatus automatically receiving said wood planks cut into individual sheets by said sawdust-free wood cutting apparatus to supply dried individual sheets; and a wood machining apparatus receiving said dried individual sheets from said drying apparatus.

9. The device according to claim 8, further comprising a humidity-conditioning apparatus for preconditioning said wood planks.

10. The device according to claim 8, further comprising means for continuously transporting the individual sheets through said drying apparatus.

11. The device according to claim 8, further comprising means for continuously transporting the individual sheets through said wood machining apparatus.

12. The device according to claim 8, further comprising a water bath receiving said wood planks after said wood planks are treated in said steaming chamber.

13. The device according to claim 12, further comprising an air-conditioning chamber arranged between said steaming chamber and said water bath.

14. A device for use with a sawdust-free wood cutting apparatus for the production of finished wood sheets from wood planks, comprising:

a drying apparatus automatically receiving said wood planks cut into individual sheets by said sawdust-free wood cutting apparatus for drying; and a wood machining apparatus receiving dried individual sheets from said drying apparatus.

15. The device according to claim 14, further comprising:

a humidity-conditioning apparatus for preconditioning said wood planks.

16. The device according to claim 14, further comprising:

a steaming chamber for heating and increasing the humidity of said wood planks prior to supplying said wood planks to said sawdust-free cutting apparatus.

17. The device according to claim 14, further comprising means for continuously transporting the individual sheets through said drying apparatus.

18. The device according to claim 14, further comprising means for continuously transporting the individual sheets through said wood machining apparatus.

19. The device according to claim 14, further comprising a heated water bath receiving said wood planks prior to supplying said wood planks to said sawdust-free cutting apparatus.

* * * * *